US007556101B2

(12) United States Patent
Chavers

(10) Patent No.: US 7,556,101 B2
(45) Date of Patent: Jul. 7, 2009

(54) DOWNHOLE RETRIEVING TOOL AND METHOD

(75) Inventor: Raymond D. Chavers, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 146 days.

(21) Appl. No.: 11/686,483

(22) Filed: Mar. 15, 2007

(65) Prior Publication Data

US 2008/0223584 A1 Sep. 18, 2008

(51) Int. Cl.
*E21B 31/00* (2006.01)

(52) U.S. Cl. ..... 166/301; 166/98; 166/209; 166/207; 166/206; 166/384

(58) Field of Classification Search ..... 166/98, 166/209, 207, 206, 301, 384, 99
See application file for complete search history.

(56) References Cited

U.S. PATENT DOCUMENTS 5,265,927 A 11/1993 Davidson, Jr.
6,896,049 B2 5/2005 Moyes
2004/0244979 A1 * 12/2004 Adam et al. ..... 166/297
2005/0057005 A1 * 3/2005 Simpson et al. ..... 277/602

OTHER PUBLICATIONS

Walker, G. "Fishing," SPE 13360, Charleston, West Virginia, Oct. 31-Nov. 2, 1984, 4 pages.
Innes, Gareth, et al. "Next Generation Expandable Liner Applications," 88022-MS, IADC/SPE Asia Pacific Drilling Technology Conference and Exhibition, Kuala Lumpur, Malaysia, Sep. 13-15, 2004, 6 pages.
ASEP Singapore PTE LTD, "Expandable Fishing Tool Guide," Sep. 25, 2008, 1 pages.

* cited by examiner

*Primary Examiner*—David J Bagnell
*Assistant Examiner*—Sean D Andrish
(74) *Attorney, Agent, or Firm*—Cantor Colburn LLP

(57) ABSTRACT

Disclosed herein is a downhole retrieving tool. The tool includes, a tubular member with a deformable portion having a reduced internal dimension, and a swage member engagable with the reduced internal dimension such that movement of the swage member through the deformable portion radially increases the internal dimension and the outer surface of the deformable portion causing the deformable portion to move radially outwardly.

3 Claims, 2 Drawing Sheets

DOWNHOLE RETRIEVING TOOL AND METHOD

BACKGROUND OF THE INVENTION

In the downhole industry the need often arises to retrieve a downhole tool or other tubular, collectively "device", to surface. Retrieving tools have been developed for just such a purpose. Retrieving tools often use expandable collets to engage features on the target tubular to be retrieved. Such retrieving tools often use mandrels that are axially movable relative to the collets to cause fingers of the collets to flexibly expand to engage with the feature of the target device. The collets and the mandrels of such retrieving tools can be expensive, complex, machined components with tight tolerances therebetween. As such, these retrieving tools may be susceptible to jamming due to contamination, for example, that may result in difficulty in actuating the tool. Accordingly, the art is always receptive to new and simple downhole retrieving tools.

BRIEF DESCRIPTION OF THE INVENTION

Disclosed herein is a downhole retrieving tool. The tool includes, a tubular member with a deformable portion having a reduced internal dimension, and a swage member engagable with the reduced internal dimension such that movement of the swage member through the deformable portion radially increases the internal dimension and the outer surface of the deformable portion causing the deformable portion to move radially outwardly.

Further disclosed herein is a method of retrieving a downhole device. The method includes positioning a deformable portion of a tubular member with an outwardly facing surface thereof downhole of a reduced dimensioned feature of a downhole device to be retrieved. The method further includes forcing a swage member through an internal dimension of the deformable portion thereby increasing a radial dimension of the outwardly facing surface such that the greatest radial dimension of the outwardly facing surface is greater than a radial dimension of the reduced dimension feature, and engaging the radial dimension of the reduced dimension feature.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of an embodiment of the disclosed apparatus and method are presented herein by way of exemplification and not limitation with reference to the Figures.

Figure 1:
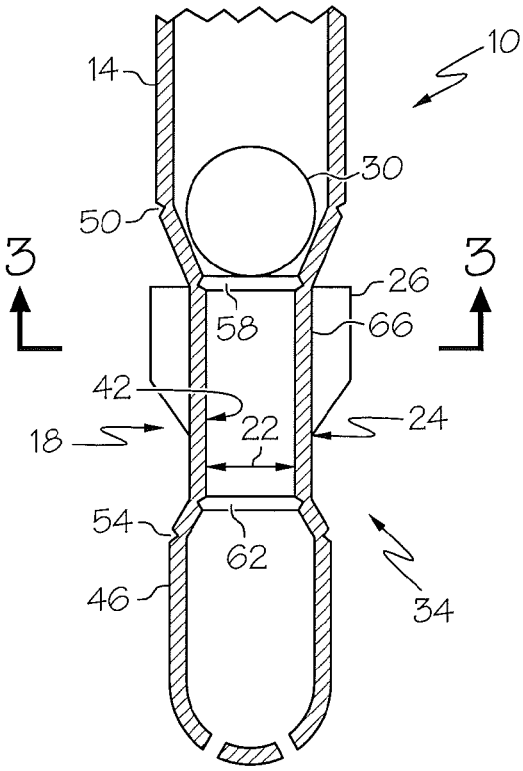
FIG. 1 depicts a cross sectional view of a downhole retrieving tool disclosed herein in a nondeformed configuration.
Figure 2:
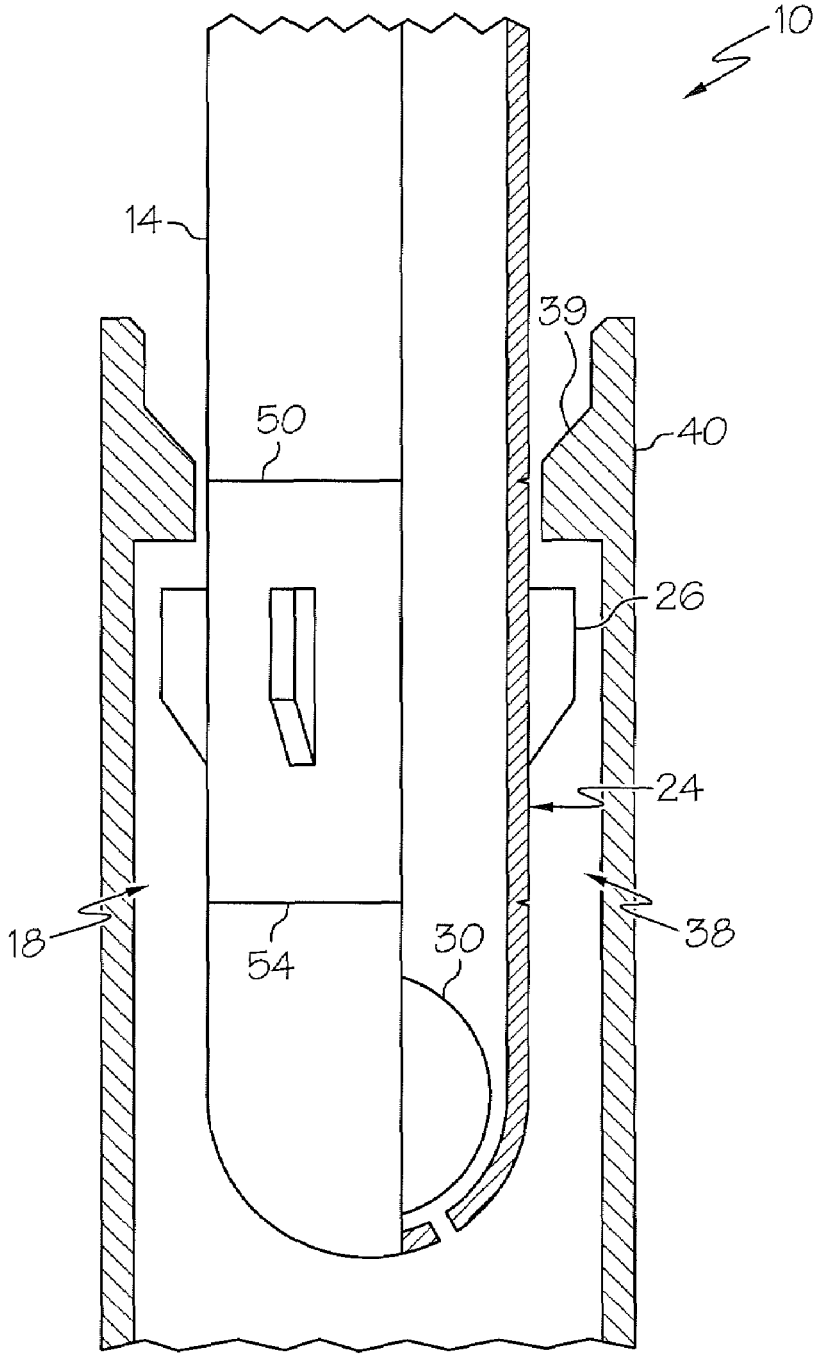
FIG. 2 depicts a partial cross sectional view of the downhole retrieving tool of FIG. 1, in a deformed configuration.

Referring to FIGS. 1 and 2, the downhole retrieving tool 10 is illustrated. The downhole retrieving tool 10 includes a tubular member 14, a deformable portion 18, with a reduced internal dimension 22 and a peripheral surface 24, a plurality of latching members 26, in one embodiment, in operable communication with the peripheral surface 24 and a swage member 30. The swage member 30 although depicted herein as a ball could also have other geometries such as, cylinder with a bullet shaped nose (ogive) or a cylinder with a conical shaped nose, for example. The deformable portion 18 deforms from a nondeformed configuration 34 to a deformed configuration 38 in response to the swage member 30 being forced axially through the reduced internal dimension 22 of the deformable portion 18. The transition from the nondeformed configuration 34 to the deformed configuration 38 results in a radial expansion of the internal dimension 22, a radial expansion of the peripheral surface 24 and movement of the latching members 26 attached thereto radially outwardly. The latching members 26 in the deformed configuration 38 are profiled to be engagable with a reduced dimension feature 39 on a target downhole device 40 to be retrieved such as a shoulder, sleeve or collar, for example, while not being engagable when in the nondeformed configuration 34.

Stated another way, the downhole retrieving tool 10 has a greater radial dimension of the latching members 26 when in the deformed configuration 38 than it does when in the nondeformed configuration 34. Thus, the downhole retrieving tool 10 can be run in a wellbore while in the nondeformed configuration 34 to a position within a target tubular to be retrieved. Since the greatest radial dimension of the latching members 26 in the nondeformed configuration is smaller than an inner radial dimension of a feature of the target tubular such as, a shoulder, a sleeve, a collar; the latching members 26 can be passed axially beyond the feature. Once the latching members 26 are axially beyond the feature, the downhole retrieving tool 10 can be deformed to the deformed configuration 38, at which time the greatest radial dimension of the latching members 26 is greater than the inner dimension of the feature and can therefore engage the feature thereby allowing retrieval of the target tubular to surface when the retrieving tool 10 is returned to surface.

Reconfigurability of the deformable portion 18 from the nondeformed configuration 34 to the deformed configuration 38 is due to the construction thereof. In one embodiment, the deformable portion 18 is formed from a section of the tubular member 14 that has four lines of weakness, specifically located both axially of the tubular member 14 and with respect to an inside surface 42 and an outside surface 46 of the tubular member 14. In one iteration of this embodiment, a plurality of lines of weakness around the deformable portion 18 work together to reduce a load required to cause the desired deformation. It is to be understood however that the lines of weakness are not required for tool of the invention to operate as described. Rather, the deformable portion 18 could also be devoid of lines of weakness and be composed of an expandable material such as an expandable metal so that the same end operability is achieved with merely an increase in the amount of force required to operate the tool. It will be appreciated that the drawing of FIG. 1 but without the lines of weakness illustrates this other embodiment.

Returning to FIG. 1 as illustrated, a first line of weakness 50 and a second line of weakness 54 are defined in this embodiment by diametrical grooves formed in the outside surface 46 of the tubular member 14. A third line of weakness 58 and a fourth line of weakness 62 are defined in this iteration by diametrical grooves formed in the inside surface 42 of the tubular member 14. The four lines of weakness 50, 54, 58 and 62 each encourage local deformation of the tubular member 14 in a radial direction that tends to cause the groove to close upon the application of an axially directed force on the swage member 30. The swage member 30 is moved through the reduced internal dimension 22 of the tubular member 14 during actuation of the tool. Axial force on the swage member 30 may be supplied mechanically or by hydraulic pressure applied to a portion of the swage that is opposed to the portion contacting the deformable portion 18. As the deformable portion 18 is actuated, the internal dimension 22 and the surface 24 thereof as well as the latching members 26 are expanded to a greater radial dimension.

Figure 3:
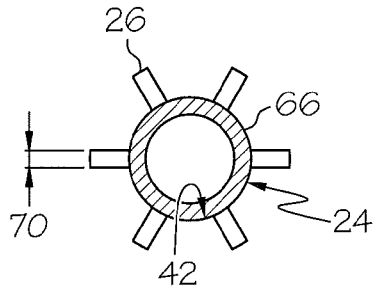
FIG. 3 depicts a cross sectional view of the downhole retrieving tool of FIG. 1 taken at arrows 3-3.

Referring to FIG. 3, radial expansion of the deformable portion 18 can be facilitated (in either described embodiment) further by reducing a thickness of a wall 66 defined by the inside surface 42 and the outside surface 24 of the deformable portion 18. A reduction of the thickness of the wall 66 can allow the wall 66 to more easily elongate as its circumference increases with the radial growth. Additionally, a width 70 of the latching members 26 can be kept at a minimal dimension so as not to interfere excessively with the circumferential elongation of the wall 66 while having adequate strength and stability to handle loads required to retrieve target devices to the surface. For symmetrical load distribution it may be advantageous to have the latching members 26 spaced at equal angles about the circumference, for example, if six latching members 26 are used they can be separated rotationally by about 60 degrees to one another. It should be noted that the latching members 26 can be machined from the material of the tubular member 14 itself or can be attached by welding, bolting or other attachment methods that are known in the industry.

While latching members have been discussed herein, it is also important to note that in one embodiment of the tool described herein, latching members are omitted. It is not necessary to include latching members providing that the outwardly facing surface can be increased in outside dimension sufficiently to engage the target device. Where the thickness of the wall of the deformable portion allows for the expansion of the portion to exhibit a larger diametrical dimension than the target device, then an interference fit will result and retrieval of the device can be effected.

Yet still it is to be appreciated that while the deformable portion has been illustrated in a cylindrical configuration, it is also possible to effect retrieval utilizing an eccentric expansion by for example running a swage 30 through the deformable portion that has a cross sectional shape other than circular.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method of retrieving a downhole device, comprising:

positioning a deformable portion of a tubular member with an outwardly facing surface thereof downhole of a reduced dimensioned feature of the downhole device to be retrieved;

forcing a swage member through an internal dimension of the deformable portion thereby increasing a radial dimension of the outwardly facing surface such that a greatest radial dimension of the outwardly facing surface is greater than a radial dimension of the reduced dimension feature;

engaging the radial dimension of the reduced dimension feature; and retrieving the device.

2. The method of retrieving a downhole tubular of claim 1, further comprising increasing a radial dimension of a plurality of latching members attached to the outwardly facing surface.

3. The method of retrieving a downhole tubular of claim 1, further comprising increasing a pressure inside the deformable portion to force the swage member through the internal dimension.

* * * * *